United States Patent [19]

Hausner

[11] 4,058,874

[45] Nov. 22, 1977

[54] METHOD FOR KNITTING AND PRE-SHRINKING KNIT FABRICS IN ACCORDANCE WITH PRE-DETERMINED COMFORT LEVELS

[75] Inventor: Franz Hausner, Reading, Pa.

[73] Assignee: Cluett, Peabody & Co., Inc., New York, N.Y.

[21] Appl. No.: 575,571

[22] Filed: May 7, 1975

Related U.S. Application Data

[63] Continuation of Ser. No. 295,866, Oct. 10, 1972, abandoned, which is a continuation-in-part of Ser. No. 129,813, March 31, 1971, abandoned.

[51] Int. Cl.[2] ..... D04B 1/24; D06C 21/00; G01L 5/06

[52] U.S. Cl. ..... 28/153; 26/18.6; 73/159

[58] Field of Search ..... 26/18.6; 73/159; 28/72 R

[56] References Cited

U.S. PATENT DOCUMENTS

| | | | |
|---|---|---|---|
| 2,721,370 | 10/1955 | Cluett et al. | 26/18.6 |
| 3,007,223 | 11/1961 | Wehrmann | 26/18.6 |
| 3,879,990 | 4/1975 | Joy | 73/159 X |

OTHER PUBLICATIONS

Press, J., *Man-Made Textile Encyclopedia,* N.Y. Textile Book Publishers, Inc., 1959, pp. 436–446, 452–456.

Reichman, C., *Knitting Encyclopedia,* N.Y. National Knitted Outerwear Association, 1972, pp. 225–227, 299–302.

Wilkinson, G., *Textured Yarn Technology,* vol. I, Monsanto Company, 1967, pp. 373, 374.

*Primary Examiner*—Robert R. Mackey

[57] ABSTRACT

Various greige fabrics are tubular knit with various knit parameters, including stitch length and stitch density, pre-treated and converted into test garments using the tubular knit fabric as the major portion of the garment, such as a man's undershirt. Selected lengths of tubular knit portions of test garments are tested by radially outwardly stretching them beyond their relaxed state a predetermined amount corresponding to the extent and manner of stretch such a garment would actually be subjected to in actual use by a wearer, and the force per lineal dimension required to so extend the garments is observed and recorded. Test garments made from different fabrics all knit with the same knit design parameters and pre-treated in the identical manner but having different stitch lengths and densities are tested to obtain a correlation between stitch length, stitch density and the force per lineal dimension of tubular garment required to stretch the garment to its wear condition. Selection is then made of a final desired stitch length and/or density that will produce a tubular garment having a comfort fit of between eight and forty grams per inch, the comfort fit being that force required to radially distend the tubular garment to its condition as worn, expressed in terms of force per lineal dimension required to distend a length of garment to its wear condition. A final greige fabric is then knit having the new selected stitch density and/or stitch length (other knit parameters and pre-treating variables being held constant) and final tubular knit garment products are made from the final knit fabric, the products having desired comfort fit of between eight and forty grams per inch.

6 Claims, 11 Drawing Figures

INVENTOR.
FRANZ HAUSNER
BY

INVENTOR.
FRANZ HAUSNER
BY

Stitch-Density and Comfort-Fit Relations for 24/1, 50% Hi-Tenacity Polyester/50% Pima Cotton Stitch-Density and Comfort-Fit Relations for 60/2 Mercerized Pima Cotton Stitch-Density and Comfort-Fit Relations for a 20-Cut Circular Milling Machine showing various Yarns ① 20/1 or 40/2 Cotton Count
② 24/1 or 48/2 " "
③ 30/1 or 60/2 " "

INVENTOR.
FRANZ HAUSNER
BY

INVENTOR.
FRANZ HAUSNER
BY

FIG. 8
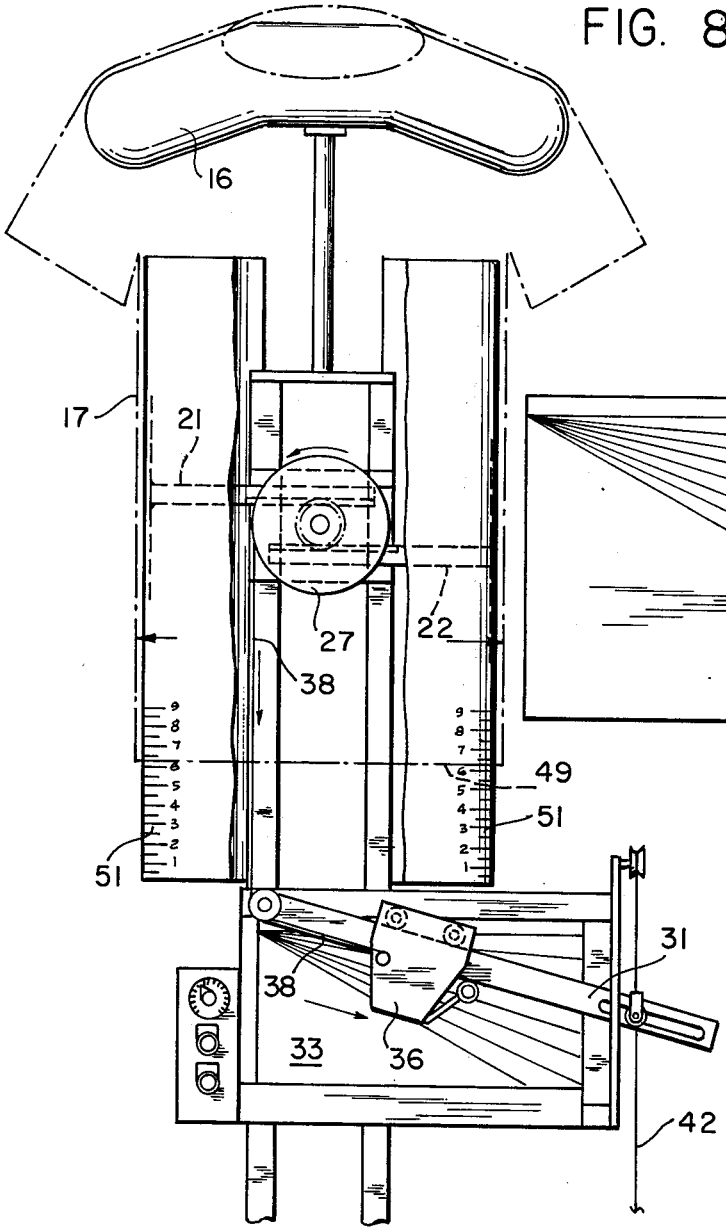
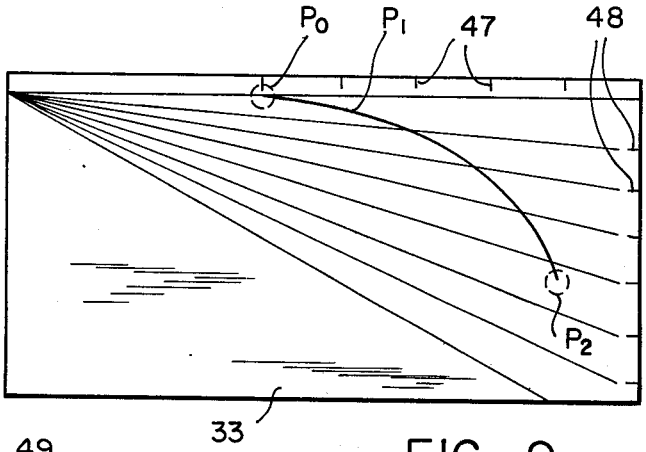
FIG. 9
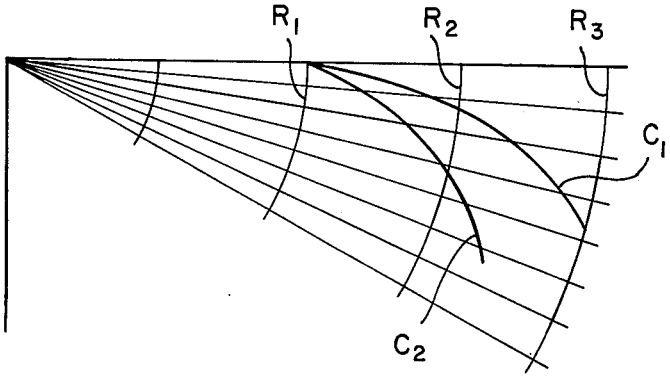
FIG. 10
INVENTOR.
FRANZ HAUSNER
BY

METHOD FOR KNITTING AND PRE-SHRINKING KNIT FABRICS IN ACCORDANCE WITH PRE-DETERMINED COMFORT LEVELS

CROSS REFERENCE TO RELATED APPLICATIONS

This application is a continuation of application Ser. No. 295,866 filed on Oct. 10, 1972, now abandoned which application is a continuation-in-part of application Ser. No. 129,813 filed Mar. 31, 1971, now abandoned.

BACKGROUND OF THE INVENTION

This invention relates to spinning, knitting, preshrinking and stabilizing fabrics, either of all-cellulosic fibers or of blends comprising cellulosic with man-made thermoplastic fibers, and is concerned more particularly with developing predictable and reliable knit-design parameters to produce knitted fabrics having dimensional stability and enhanced comfort fit of garments made therefrom.

In knitted fabrics, as distinguished from woven fabrics, the fabrics are constructed in both their lengthwise and widthwise directions by series of interlocked loops formed by continuous yarns or series of continuous yarns. As a result, knitted fabrics have substantial interdependence of their length and width dimensions, and they are distortable easily. This property has made knitted fabrics desirable for many articles of apparel; because of ability of garments made of knitted fabrics to conform to bodies and change their shapes for accommodating body movements. However, it seems fair to note that this foregoing desirable property, which enhances acceptability of knitted fabrics for wearing apparel, presents formidable problems in processing knitted fabrics. Such problems are compounded by need of knitted fabrics to recover and retain their shapes in garments as made after repeated wearings and washings. These problems are compounded further when knitted fabrics are blended of a man-made thermoplastic component (such as a polyester) with a cellulosic fiber component (such as cotton or rayon).

It has been difficult properly to knit, preshrink and stabilize fabrics of all-cellulosic fibers, as well as fabrics blended of man-made thermoplastic and cellulosic fibers, so as to control accurately and uniformly knitting, preshrinking and stabilizing of the fabrics whereby to provide predictable and uniform dimensional stability. Prior-art methods of knitting, preshrinking and stabilizing such fabrics also have been deficient in comfort fit of garments formed therefrom. Further these prior-art methods have affected adversely other properties of such fabrics.

SUMMARY OF THE INVENTION

Selection of knit-design parameters, preshrinking and stabilizing knitted fabrics to provide dimensional stability and to enhance comfort fit is achieved as set forth herein in a particularly novel and facile manner. First for a selected fabric, knitting machine and knitting procedure; conventional knitting, warp knitting, double knitting or others, a yarn twist selection method is disclosed to provide a torque-free yarn; then fabric is knitted using such yarn according to knit-design parameters whose values can be subsequently checked by a machine disclosed herein to adjust the parameters to produce knit fabric having a predetermined comfort level, e.g. for men's undershirts 10 - 30 grams per inch. For present purposes the term "comfort fit level" is intended to represent that force required to radially distend to a predetermined extent a tubular knit garment made from a selected tubular knit fabric, and expressed in terms of force per lineal dimension required to radially stretch or distend the fabric of the garment. The force, of course, also represents the reaction force of the fabric tending to return it to its original relaxed state when it is distended or stretched. The extent of distension is carefully correlated to the stretched condition of the garment when it is worn by a user, hence the use of the expression "comfort fit." The knit-design parameters are the following:

$$N = cpi \times wpi = K_1/L^2$$

$$cpi = K_2/L$$

$$wpi = K_3/L$$

$$\text{Flat width} = nL/2K_3$$

Wherein:

$N$ = Stitch density $cpi$ & $wpi$ = Courses/inch & wales/inch, respectively $K_1$, $K_2$ & $K_3$ are constants $L$ = Stitch length (Inches of yarn per loop)

$n$ = Total needles in the machine $K_1 = K_2 \times K_3$.

Preshrinking and stabilizing knitted fabrics of all-cellulosic fibers is accomplished (in either open web or tubular form) by dampening the fabrics in a fully relaxed condition and immediately thereafter preshrinking compressively and drying the fabrics. The all-cellulosic fabrics are stabilized then by allowing them to rest at ambient temperature and ambient humidity for not less than 24 hours. Preshrinking and stabilizing knitted fabrics blended of man-made thermoplastic with cellulosic fibers are achieved (in either open web or tubular form) by dampening the blended fabrics in a fully relaxed condition and immediately thereafter preshrinking compressively while stretching the fabric width-wise, drying and heat setting the blended fabrics.

Accordingly, one object of this invention is to permit correlation of properties in the treated fabrics (desired to be derived according to the methods here contemplated) with significant knit-design parameters so as to accommodate reliable preselection of knit-design parameters whereby the properties desired in the treated fabrics are achievable.

Another object of this invention is to provide knit-design parameters which enable a knitter to predetermine reliably and accurately sizes to produce dimensional stability and enhance comfort fit of garments.

Still another object of this invention is to produce knitted fabrics suitable for manufacture into garments, whereby shapes of said garments are restorable elastically on relaxation of deforming forces.

Still another object of this invention is to preshrink fabrics so that shrinkage of garments made therefrom will not; during any subsequent treatment, such as washing and/or drying and/or the like; exceed its comfort-fit range.

Still another object of this invention is to provide preshrunk and stabilized knitted fabrics which may be made into garments having improved stretch and resilience (the "comfort fit" of the garment, so to speak).

Still another object of this invention is to provide a knitted fabric of improved smoothness and general appearance.

Still another object of this invention is to provide arrangements of apparati for carrying out the preshrinking and stabilizing methods of this invention; which arrangements can accommodate wide varieties of fabrics, are economical to install and operate, allow for rapid and convenient startup and shutdown and are well suited otherwise to their intended functions.

BRIEF DESCRIPTION OF THE DRAWINGS

The foregoing and other objects will be understood more fully from the discussion and description of preferred embodiments which follow, taken in conjunction with the accompanying drawings wherein:

FIG. 6 is an elevational view of a testing apparatus for determining comfort fit of knitted Tee shirts, knitted tubes and/or the like.

FIG. 8 is a partial view similar to FIG. 6 of the apparatus in an alternate position of operation.

FIG. 9 is an enlarged view of a recording chart usable in the apparatus of FIGS. 6–8.

FIG. 10 is an enlarged view of an alternate recording chart for clarifying effects of variables inherent in operation of the apparatus of FIGS. 6–8.

DISCUSSION AND DESCRIPTION OF PREFERRED EMBODIMENTS

Figure 1:
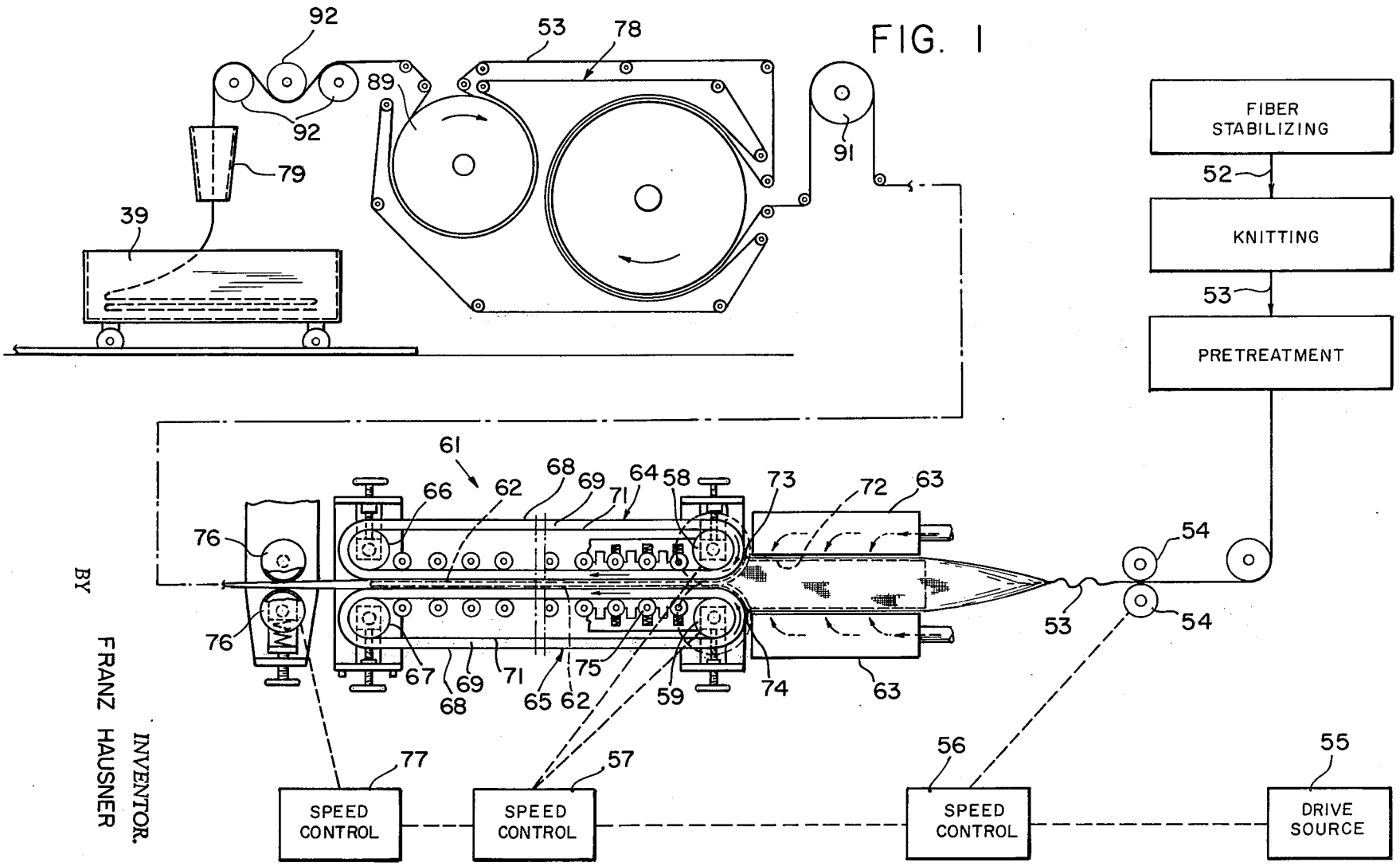
FIG. 1 is a somewhat idealized schematic diagram depicting an arrangement of apparati for carrying out preshrinking and stabilizing of knitted fabrics in tubular form.

At the core of processing knitted fabrics must be comfort fit for the wearer, because it is on comfort fit that market acceptance is predicated. Apparatus is available which test stretch and resilience of knitted tubes or the like (the "comfort fit" of the knit): Stretch being indicated by force required to produce a measured distention and resilience indicated by return of the knitted tubes to their original girth. By way of leading into an understanding of the present invention, an apparatus for measuring comfort fit shown in FIGS. 6–10 shall now be described although it should be understood that other apparatus and/or testing techniques can be used for this purpose, and that the specific form of the apparatus of FIGS. 6–10 is not a part of the present invention.

The invention is concerned with knitting the fabric in accordance with knit design parameters which provide for design control of the fabric primarily in terms of stitch density and stitch length. By varying these two factors, different comfort levels width-wise or circumferentially about the body of the wearer may be achieved. For example, it has been determined by tests wherein men's undershirts were constructed to have different and predetermined force (comfort) levels about the body of samplings of wearers, that an ideal comfort level is approximately 30 grams of inwardly directed pressure for each 1 inch of length of the undershirt. Different comfort levels can be arrived at in this way for other types of garments, for example, men's or ladies' shirts, waist bands, etc. As mentioned, the most important consideration in the control of these comfort levels is stitch density and stitch length in knit goods. If, for example, the garment when tested in accordance with the apparatus of FIGS. 6–10, has a comfort level of 60 grams to the inch, by using the knit design parameters disclosed herein, it will be possible to (a) reduce the stitch density; (b) increase stitch length, or (c) a combination of both (a) and (b) in order to reduce the force of 60 grams to a predetermined comfort level of say 30 grams. Moreover, the knit design parameters lend themselves to proportionate percentage changes of these parameters to raise or lower comfort levels. Changes to stitch density or stitch length or both can thus be made percentagewise in accordance with what is thought to be merchandisable in the end product. In other words, in some instances, it will be desirable not to change stitch density at all, if the weight of the fabric is to remain unaffected; or, if the overall weight is not critical, stitch density may be varied to lower or raise the comfort level and stitch length may remain the same.

In accordance with the present invention, therefore, a fabric will be knit in accordance with knit design parameters disclosed herein. Next, the fabric will be subjected to preshrinking in accordance with certain novel procedures taught herein; and a garment made from the fabric will then be checked or tested on the apparatus of FIGS. 6–10 to determine whether or not the comfort level of such garment is the ideal or optimum which the garment manufacturer wishes to achieve. It will be obvious that up to this point the fabric manufacturer will have made certain assumptions in selecting knit design parameters, especially those of stitch density and stitch length. When the fabric has been preshrunk and the garment made therefrom is actually checked on the apparatus of FIGS. 6–10, these assumptions will be invalidated or proved correct according to the comfort level reading in grams per inch of length which results. As indicated above, if the comfort level reading is significantly different from that which is the level to be achieved, the manufacturer will simply make such changes as he sees fit in the knit design parameters stitch density and/or stitch length in order to move the comfort level toward the optimum. The process is then repeated. A new fabric is then knitted which after preshrinking and conversion to a garment will be tested to compare its comfort level against the prescribed optimum. This process is repeated until final knit design parameters of stitch length and density are determined which produce the prescribed comfort level after preshrinking.

Figure 6:
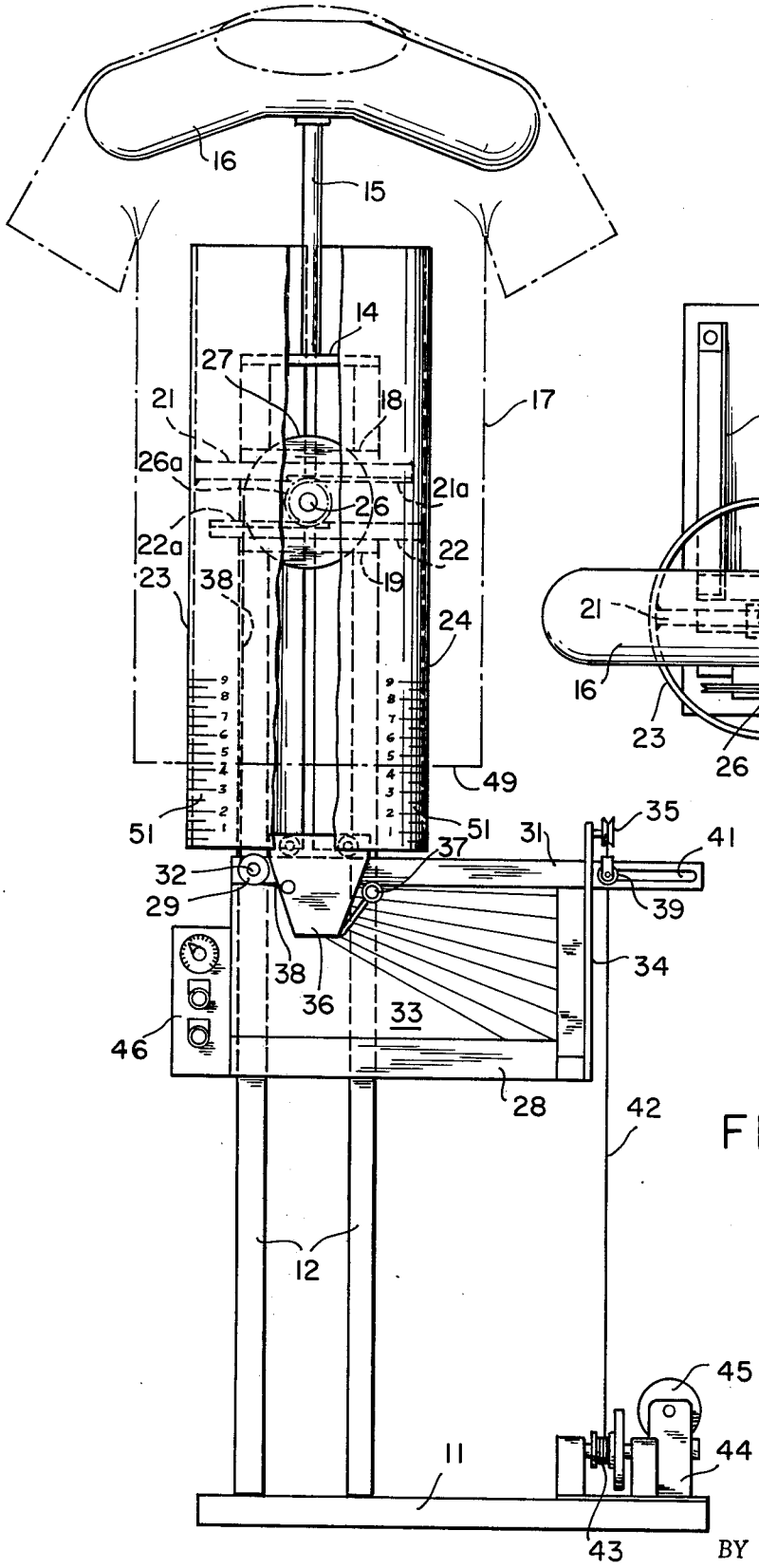
Figure 7:
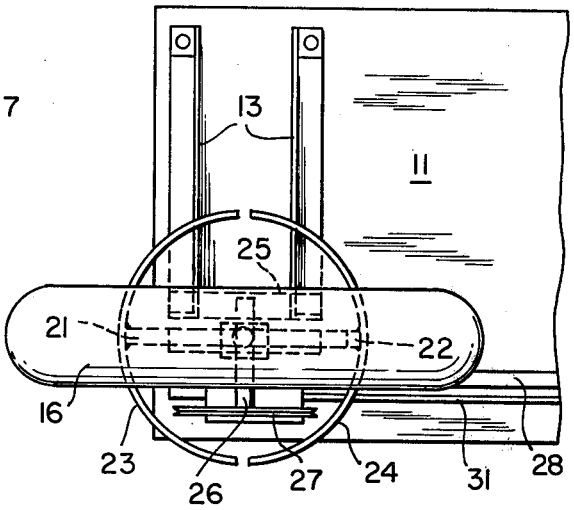
FIG. 7 is a top view of the apparatus of FIG. 6.

As best seen in FIG. 6, base 11 mounts a pair of vertical angles 12 rigidized by rear-mounted angle braces 13 (best seen in FIG. 7). At the top of angles 12, on cross brace 14, post 15 mounts form 16 over which may be draped knitted tube 17 or the like. A pair of cross braces 18 and 19, which span between angles 12, are adapted to receive a pair of cross rods 21 and 22 in slidably retained fashion. Cross rod 21 carries member 23 which is provided with a convex surface to simulate one half of a torso (or other body portion) of a wearer. Cross rod 22 carries member 24 with a convex surface similar and complimentary to the convex surface of member 23 so that members 23 and 24 coact to simulate in this case chest action of a wearer of a garment made from the knitted tube.

Members 23 and 24 are directed toward and away from each other by rack and pinion action. Cross brace 25, spanning between angles 12 (as best seen in FIG. 7) spindles shaft 26 which carries sheave 27. As best seen in FIGS. 6 and 8, cross rods 21 and 22 have affixed thereto respectively racks **21*a* and 22*a*, while shaft 26 has pinion 26*a* which is adapted to engage said racks. Frame 28 positioned downwardly on angles 12 from sheave 27 mounts pulley 29 and weight-riding beam 31 pivoted on shaft 32 concentric with pulley 29. Frame 28 is provided further with chart 33 and slotted guide 34 defining the vertical path of beam 31. At the upper end of frame 28 is provided fixed pulley 35**.

Traversing of members 23 and 24 is effected by movement of weight 36 down beam 31. Weight 36 is adapted to roll down beam 31 and has attached to it scriber 37 maintained in contact with chart 33. Cable 38, attached to weight 36, passes around pulley 29, up to and around sheave 27, and is attached thereto. Inspection shows that the moment developed by weight 36 about the rotational axis of pulley 29 will (unless opposed) cause members 23 and 24 to move outwardly. Control means include pulley 39 rolling in slot 41 formed in beam 31, and motion of beam 31 is confined in a vertical plane by guide 34. Pulley 39 is connected by cable 42 passing around pulley 35 to winch 43, driven through speed reducer 44 by motor 45. A panel 46 is provided by means well known to control power, speed and direction of motor 45. On movement of weight 36 down beam 31, scriber 37 describes a curve on chart 33. It should be noted that the force of cable 38 is variable, even though weight 36 is constant. As an aid to reading curves on chart 33, as shown in FIG. 9, horizontal calibrations 47 and vertical calibrations 48 are added. As seen in FIGS. 6 and 8, the position of margin 49 can be measured on scales 51.

Accordingly, this testing device is operated by winching out cable 42, causing beam 31 to rotate downwardly about shaft 32 so that weight 36 rides down beam 31 pulling cable 38 to rotate sheave 27 and pinion **26*a* thereby moving crossrods 21 and 22 outward to move concave members 23 and 24 simulating the action in this case of a wearer's torso during breathing or other expanding activities. While this operation progresses, scriber 37 traces movement of weight 36 on chart 33 to provide a measure of the yield and consequently the comfort fit of knitted tube 17 under simulated wear conditions. More particularly weight 36 would start at zero position $P_0$ (as best seen in FIG. 9) as motor 45 is started in the unwind direction. As beam 31 rotates clockwise through a small angle, weight 36 overcomes static friction. and rolls rapidly to point $P_1$ determined by the traversing of members 23 and 24 up to their engagement with knitted tube 17. Therefore, the curve between points $P_0$ and $P_1$ is substantially straight. Pull on cable 38 increases as beam 31 declines. Therefore from $P_1$ to the final point $P_2$ (where elastic strength of knitted tube 17 equals the force imposed thereon by members 23 and 24**) the curve is not straight. The shape of the curve and the position of point $P_2$ depend on the following:

1. magnitude of weight 36;
2. speed of motor 45;
3. size of knitted tube 17; and
4. elasticity of the knitted tube (change of distention as the knitted tube is loaded).

Point $P_2$ serves as an important index for any test wherein weight 36, rate of speed of motor 45 and size of the knitted tube are constant. The shape of the curve between points $P_1$ and $P_2$ is also of value in analyzing changes of elasticity in the knitted tube and consequently its comfort fit.

Referring to FIG. 10, magnitudes of stretch $R_1$, $R_2$ and $R_3$, as well as angles of declination of beam 31 lend themselves to analysis by polar coordinates. Also as seen in FIG. 10, for a knitted tube with relatively little comfort fit, the curve will tend to be steep such as $C_2$; whereas for a knitted tube with more comfort fit, the curve will tend to be more flat such as $C_1$.

Correlating the load on knitted tube 17 to lineal dimension required to distend the knitted fabric to its condition of stress as it is used in a garment, two lengths of knitted tube 17 stretched between members 23 and 24 are taken. The following table shows typical values for bracketing the desired range of from 10 to 30 grams per inch of length of knitted tube 17 stretched to actual wear conditions.

KNITTED GARMENT TESTER - TEST VALUES

"B" - Garment length - relaxed
"C" - Amount of shell coverage
"D" - 30 gr./in. of "C" × 2
"E" - 10 gr./in. of "C" × 2

| "B" | "C" | "D" | "E" |
|---|---|---|---|
| 32 | 24.5 | 1470 | 490 |
| 31 7/8 | 24.375 | 1462.5 | 487.5 |
| 31 3/4 | 24.25 | 1455 | 485 |
| 31 5/8 | 24.125 | 1447.5 | 485 |
| 31 1/2 | 24.0 | 1440 | 480 |
| 31 3/8 | 23.875 | 1432.5 | 477.5 |
| 31 1/4 | 23.75 | 1425 | 475 |
| 31 1/8 | 23.625 | 1417.5 | 472.5 |
| 31 | 23.5 | 1410 | 470 |
| 30 7/8 | 23.375 | 1402.5 | 467.5 |
| 30 3/4 | 23.25 | 1395 | 465 |
| 30 5/8 | 23.125 | 1387.5 | 462.5 |
| 30 1/2 | 23.0 | 1380 | 460 |
| 30 3/8 | 22.875 | 1372.5 | 457.5 |
| 30 1/4 | 22.75 | 1365 | 455 |
| 30 1/8 | 22.625 | 1357.5 | 452.5 |
| 30 | 22.5 | 1350 | 450 |

It has been discovered that a useful approach to correlating dimensional stability, comfort fit and other meaningful properties of treated knitted fabrics to knit-design parameters is to consider loop-design and stitch-length theory. Formulae that are of practical value are as follows:

$$N = cpi \times wpi = K_1/L^2 \quad (1)$$

$$cpi = K_2/L \quad (2)$$

$$wpi = K_3/L \quad (3)$$

$$\text{Flat width} = nL/2K_3 \quad (4)$$

wherein:

$N$ = Stitch density

*cpi* & *wpi* = Courses/inch & wales/inch, respectively $K_1$, $K_2$ & $K_3$ are constants whose values depend upon various factors such as fibers used, yarn count, types of processing, etc.

$L$ = Stitch length (Inches of yarn per loop)
$n$ = Total Needles in the machine
$K_1 = K_2 + K_3$ As a practical approach to check stitch length (L) in a given piece of knit fabric, the piece of fabric may be marked precisely to define a 10 inch segment widthwise across the fabric. The number of loops widthwise in this marked section are then counted and the stitches in the 10 inch line are unraveled, one thread being extracted where the 10 inch marking is clearly visible. LThe thread is extended to its full length and measured without overstretching. The total length divided by total number of loops provides "stitch length." Constants $K_1$, $K_2$ and $K_3$ depend on several factors such as:

a. Fabrics have to be handled differently in wet processing because of problems inherent in drying and/or heat setting.

b. A fabric blended of man-made thermoplastic and cellulosic fibers has to be overstretched to prevent crows feet and creases, also temperatures have to be adjusted to eliminate inherent elasticity of the man-made thermoplastic fibers.

c. A fabric of cellulosic fibers has to be relaxed and dried not to arrive below its natural regain factor of 6½%.

d. Speeds at various phases of the operation are material factors with regard to shrinkage and uniformity.

Knitted fabrics that meet requirements of dimensional stability, comfort fit and the like have been selected and from stitch density and correlations of stitch density to other significant knit-design parameters (found in the fabrics with desirable properties), knit-design parameters for greige fabric are determinable. These relationships will be seen more fully from the following examples which are to be construed as illustrative rather than limiting.

In accordance with the teachings of the present invention, yarn shall first be constructed to produce a torque free fabric. This is controlled on the cotton spinning system by the "twist multiplier," where the twist multiplier is used to determine the number of twists by the formula the square root of yarn count times twist multiplier. A piece of fabric must be knitted (e.g. on a circular knitting machine) by taking one needle out of the machine, leaving a runner in the cloth. The cloth is cut from the machine and laid flat on a table. The deviation of the runner from a line parallel with the cloth edge is measured. This deviation has to be eliminated by the spinner by adding or subtracting twist. For example, on 1.5 inches long, 1.5 denier staple polyester blended 50% with 1.375 inches long cotton of 3.9 micronnaire, the twist multiplier should be 2.9 to 3.0. This should be contrasted with what was formerly though to be a correct twist multiplier of 3.75. Once the yarn twist has been determined, yarn tensions on yarn feeds (of circular knitting machines) must be checked. This varies with fiber friction, cone winding, cone type, cone holding arrangement. There should be no more than 3 grams of tension over an unrestricted movement of yarn. In other words, tension in the knitting machine must be reduced to substantially negligible amounts.

EXAMPLE I

Figure 3:
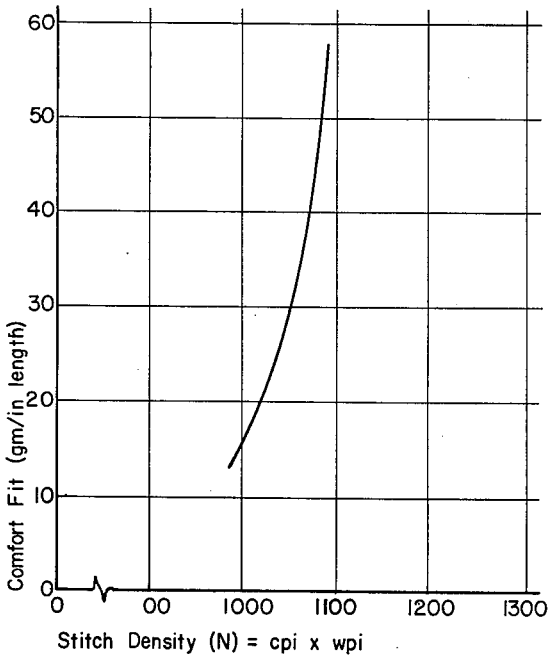
FIG. 3 is a graphical representation of stitch-density and comfort-fit relations for a 24/1 50% Hi-Tenacity polyester/50% Pima long-staple cotton.

A fabric made from 24/1, 50% Hi-Tenacity polyester and 50% Pima, long-staple cotton was studied. The staple length of the blended yarn is 1½ inches and it is of 1½ denier using a 3.0 twist multiplier. The yarn was steam set on a cone in a steam chamber for 2 hours at 180° F. wet bulb and 170° F. dry bulb humidity. This heat stabilized the fibers to reduce springiness or liveliness and made the fabric easier to use because it was made softer and more compatible with subsequent operations and it also had reduced fabric torque. A graphical relationship (shown as FIG. 3) was developed, using the apparatus of FIGS. 6–10, between stitch density and comfort fit (measured in grams per inch of length of fabric) with desired dimensional stability and comfort fit for the knitting machine, preshrinking and stabilizing method employed and the knitting procedure employed. From a number of constructions and from this graphical relationship, required stitch density for a specific comfort fit with dimensional stability was selected. By means of the preceding formulae, a table of knit-design parameters set forth below was developed.

| Actual Sizes | Knitting Used | | | | | | | | | |
|---|---|---|---|---|---|---|---|---|---|---|
| Mach. Size | Fin. Size* | cpi | wpi | N | L | $K_2$ | $K_3$ | Comfort Level | Calculated Greige L ** | Calculated* Fin. Width |
| 19 | 21 | 33½ | 30 | 1005 | 0.129 | 4.32 | 3.87 | 18.5 | 0.133 | 20 |

*Tubular width to be used for size 44. Equipment used was a 20 cut spring needle machine.
**Calculated on the basis of 3% yarn shrinkage.

The stitch length (L) given in the preceding table is in the finished washed fabric and was corrected for greige fabric (Greige L) at the knitting stage by establishing the yarn shrinkage from skein shrinkage method ASTM-2259-68T using the following formula:

$$\text{Greige L} = L \times (1 + (\%\ \text{Shrinkage}/100)) \quad (5)$$

Thusly, the knitter was directed to construct a greige fabric of a given stitch length on a specific size and cut of machine and the finished width was as calculated by formula (5) preceding. After the knitter reached and tested for this setting, he reduced the *cpi* by 10% through takeup to accommodate the increase in cpi that occurs during finishing of the fabric.

The knit-design parameters given in the preceding table are valid for the specific treatment sequence to which this fabric was subjected. This fabric was kier bleached, prespread, and dried in a jet dryer in a completely relaxed state at a temperature of no more than 250° F. so that there was no heat setting at the drying stage. The tubular knit fabric was then moistened and given a pass through a tube compressive-shrinkage unit for preshrinking and was dried and heat set on a belted dryer. Any deviations from this treatment sequence can produce results which may be entirely different from those obtained hereon.

The fabric knitted according to the foregoing knit-design parameters and treated in the manner specified was found to be stable dimensionally. The fabric has improved stretch and resilience in both length and width. Nominal shrinkage is experienced because of yarn swelling and nonavailability of exact machine sizes. Further, it has been found desirable to finish spread approximately one inch wider than the formula to overcome stresses that had to be applied to remove crows feet and creases.

EXAMPLE II

Figure 4:
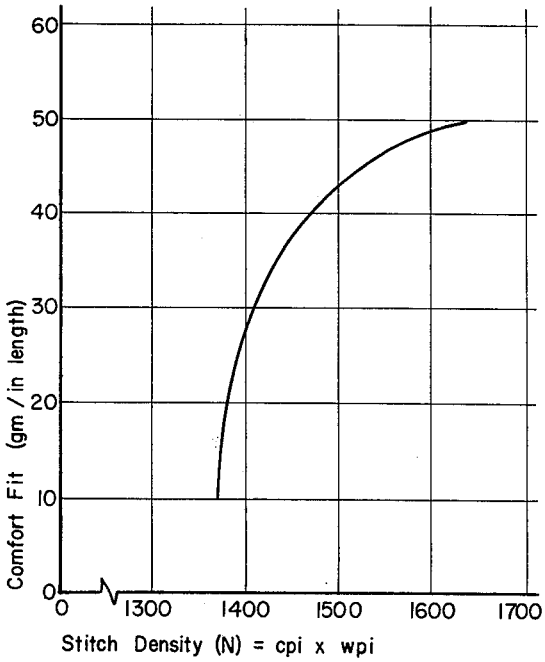
FIG. 4 is a graphical representation of stitch-density and comfort-fit relations for a 60/2 mercerized Pima long-staple cotton.
Figure 5:
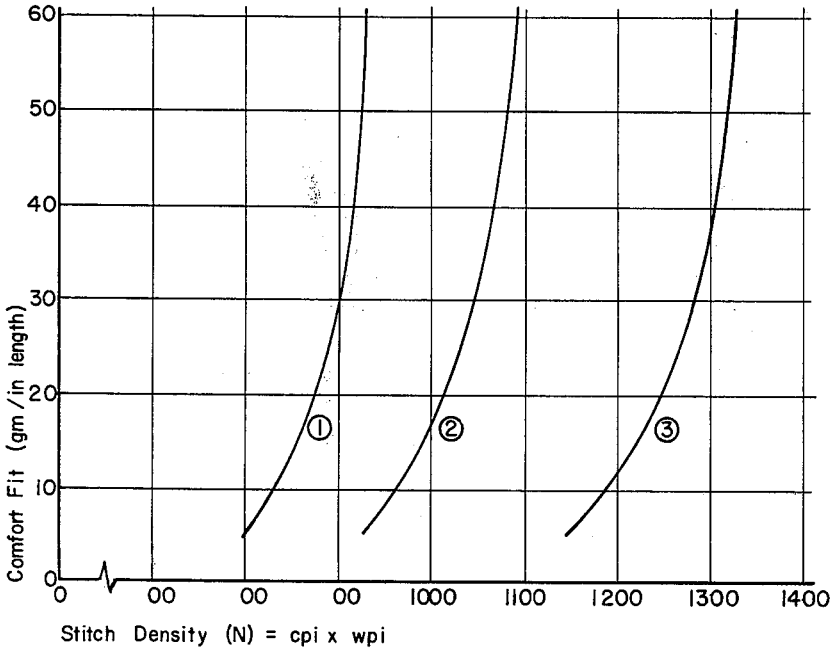
FIG. 5 is a graphical representation of stitch-density and comfort-fit relations for a 20 cut circular knitting machine showing various yarns.

A fabric made from 60/2, 100% Pima, long-staple, mercerized cotton was studied. The staple length of this yarn is one and three eighths inches in a single yarn using a 3.5 "Z" twist multiplier and a 2.5 "S" twist multiplier in doubling to obtain a balanced knit yarn. The yarn was conditioned at about 140° F. to produce full commercial retain. This twist factor relationship reduced springiness making the fabric soft and compatible for subsequent operations as well as reducing fabric torque. A graphical relationship (shown as FIG. 4) was developed, using the apparatus of FIGS. 6–10, between stitch density and comfort fit (measured in grams per inch of length of fabric) with desired dimensional stability and comfort fit for the knitting machine, preshrinking and stabilizing method employed and the knitting procedure employed. From a number of constructions and from this graphical relationship, required stitch density for a specific comfort fit with dimensional stability was selected. By means of the preceding formulae, a table of knit-design parameters set forth below was developed.

| Actual Sizes | Knitting Used | | | | | | | | | |
|---|---|---|---|---|---|---|---|---|---|---|
| Mach. Size | Fin. Size* | cpi | wpi | N | L | $K_2$ | $K_3$ | Comfort Level | Calculated Greige L ** | Calculated* Fin. Width |
| 18 | 21 | 38 | 37 | 1408 | 0.113 | 4.29 | 4.18 | 26.8 | 0.124 | 21 |

*Tubular width to be used for size 42 or 44 T shirt. 60/2, twist multiplier, single-3.50"B", two ply-2.50 "S". Equipment used was a 28 cut spring needle machine.
**Calculated on the basis of 9% yarn shrinkage.

The stitch length (L) given in the preceding table is in the finished washed fabric and was corrected for greige fabric (Greige L) at the knitting stage by establishing the yarn shrinkage from skein shrinkage method ASTM-2259-68T by using following formula:

$$\text{Greige L} = \text{L} \times (1 + (\%\ \text{Shrinkage}/100) \qquad (5)$$

Thusly, the knitter was directed to construct a greige fabric of a given stitch length on a specific size and cut of machine and the finished width was as calculated by formula (5) preceding. After the knitter had reached and tested for this setting, he reduced the *cpi* by 10% through takeup change to accommodate the increase in *cpi* that occurs during finishing of the fabric.

The knit-design parameters given in the preceding table are valid for the specific treatment sequence to which this fabric was subjected. This fabric was kier bleached, prespread, and dried in a jet dryer in a completely relaxed state at a temperature of no more than 250° F. so that there was no overdrying or scorching at the drying stage. The tubular knit fabric was then moistened and given a pass through a tube compressive-shrinkage unit for pre-shrinkage and was dried and heat set on a belted dryer. Any deviation from this treatment sequence can produce results which may be entirely different from those obtained hereon.

The fabric knitted according to the foregoing knit-design parameters and treated in the manner specified was found to be stable dimensionally. The fabric has improved stretch and resilience in both length and width. Nominal shrinkage is experienced because of yarn swelling and nonavailability of exact machine sizes. Further, on this fabric it has been found desirable to finish to the formula width rather than wider than the formula.

Figures 2, 2A:
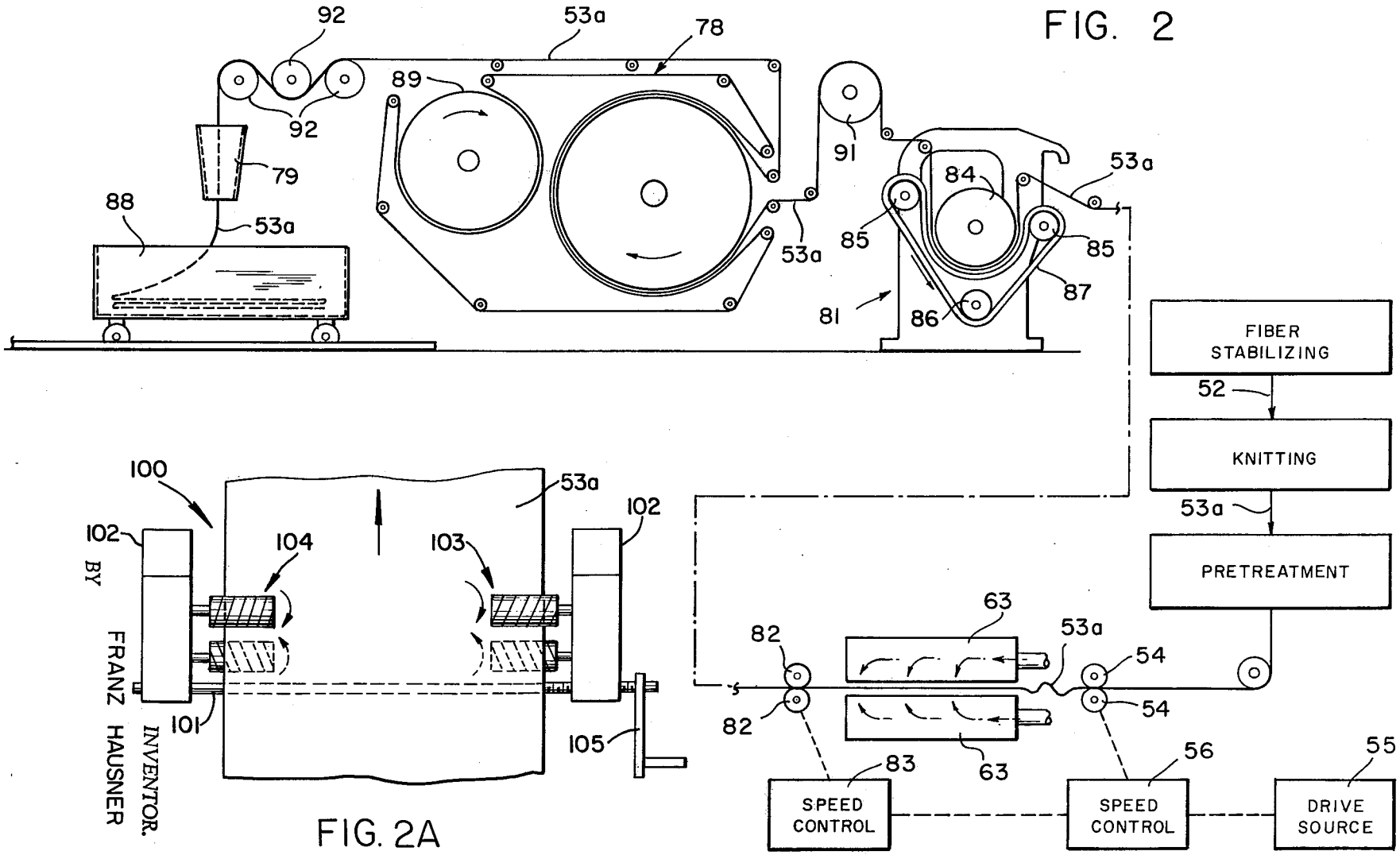
FIG. 2 is a somewhat idealized schematic diagram depicting an arrangement of apparati for carrying out preshrinking and stabilizing of knitted fabrics in open webs.
FIG. 2A is a detail of a web expander used in conjunction with the apparatus of FIG. 2.

The basic arrangement of apparati for preshrinking and stabilizing tubular knitted fabrics is shown in FIG. 1 and a comparable arrangement of apparati for preshrinking and stabilizing open-web knitted fabrics is shown in FIG. 2. The primary difference between these two arrangements lies in the compressive-shrinkage units employed therein. A fiber-stabilized yarn blend of man-made thermoplastic fibers with cellulosic fibers or an all-cellulosic yarn 52 is knitted and tubular knitted fabric 53 (FIG. 1) or open-web knitted fabric **53*a* (FIG. 2**) results.

The fabric blended of man-made thermoplastic fibers with cellulosic fibers is pretreated thereafter in a series of steps which generally comprise in sequence:

1. Scouring using a chemical detergent with a fluorescent component and having a scouring liquid temperature of about 155° F.
2. Kier bleaching with peroxide and silicates for from 4 to 6 hours at a maximum temperature of 190° F.
3. Rinsing with a dilute solution of acetic acid (or the like) to neutralize the fabric to a pH close to 7.
4. Softening and/or tinting and/or applying a rewetting agent.
5. Running the fabric through a squeeze pad to reduce its moisture content to about 60% by weight.
5. Feeding the fabric in a fully relaxed condition to a multiple-drum dryer having a maximum temperature of 250° F. from which it may be folded into a cart for steaming, compressively preshrinking, drying and heating which are at the crux of the present invention as applied to fabrics blended of man-made thermoplastic fibers with cellulosic fibers. It should be understood that wide variations in pretreatment are contemplated, depending on prior history of fibers, available equipment, the end use of the treated fabric and the like; but temperture of the fabric is not permitted to exceed 250° F. during such pretreatment.

For a fabric made of all-cellulosic fibers, pretreatment would comprise the following steps in sequence:

1. Scouring using a chemical detergent with a fluorescent compound and having a scouring liquid temperature of about 155° F.
2. Kier bleaching with peroxide and silicates for from 6 to 8 hours at a maximum temperature of 180° F.
3. Rinsing with a dilute solution of acetic acid (or the like) to neutralize the fabric to a pH close to 7.
4. Softening and/or tinting and/or applying a rewetting agent.

5. Running the fabric through a squeeze pad to reduce its moisture content to about 80% by weight.

6. Feeding the fabric in a fully relaxed condition to a multile-drum dryer having a maximum temperature of 250° F. from which it may be folded into a cart for steaming, compressively preshrinking, drying and relaxing which are at the crux of the present invention as applied to all-cellulosic fabrics. Here again, it should be understood that wide variations in pretreatment are contemplated, depending on prior history of fibers, available equipment, the end use of the treated fabric and the like.

After pretreatment, knitted tube fabric 53 is fed by feed rollers 54 continuously through the arrangement of apparati shown in FIG. 1. It is desirable to dampen fabric 53 in a completely relaxed state. Toward this objective, a drive source 55 and speed controller 56 are connected operatively to feed rollers 54, also drive source 55 and speed controller 57 are connected operatively to driving rollers 58 and 59 of tube compressive-shrinkage unit generally designated 61, so that the speed of advance of fabric 53 to form 62 is greater than the speed of entry of fabric 53 into tube compressive-shrinkage unit 61. By way of example, it has been found that, with a circular knitted fabric 53 consisting of 100% cellulosic two ply yarn, an overfeed of 3% at feed rollers 54 with regard to entry of fabric 53 into tube compressive-shrinkage unit 61 effects complete relaxation of fabric 53 during steam dampening thereof by water-spray and steam boxes 63, and eliminates any longitudinal tension of substance in fabric 53 during such dampening. This dampening, while fabric 53 is fully relaxed, insures uniform moisture content and heating of the fabric to a desired temperature. It has been found also that, with a circular knit fabric 53 consisting of a blend having a range of from 50% to 65% polyester and from 50% to 35% cotton, an overfeed of 3% at feed rollers 54 with regard to entry of fabric 53 into tube compressive-shrinkage unit 61 effects complete relaxation of fabric 53 during dampening thereof by water-spray and steam boxes 63, and eliminates any longitudinal tension of substance in fabric 53 during such dampening.

With knitted fabric 53 in a tubular form, tube compressive-shrinkage unit 61 (as described in U.S. Pat. No. 3,007,223 and as shown in FIG. 1) is employed. Tube compressive-shrinkage unit 61 comprises a pair of endless belts 64 and 65 moving respectively on rearward turning rollers 58 and 59 and on forward turning rollers 66 and 67, referenced to the path of fabric 53. The belts are formed of a suitable material (such as rubber) so that at least the exterior portions thereof are stretchable and provide firm outer surfaces having relatively high coefficients of friction. Each of the belts shown in FIG. 1 is formed of solid rubber having a firm outer surface 68, a stretchable exterior portion 69, and an interior portion 71 which is reinforced by fabric. This construction provides sufficient yielding in exterior portion 69 of each belt so that the rearward turning roller 58 or 59 will stretch enough so as to provide a surface moving at a greater speed than the exterior of the rearward turning roller and the outer surfaces at the straight portions of the belt.

Floating freely between the belts is form 62 which has exceptionally smooth surfaces and which is made of aluminum to provide a slip surface. Form 62 is adapted to receive tubular fabric 53 which is moved thereover. Form 62 is held in place by drag of fabric tube 53 urging enlarged portion 72 of form 62 against belts 64 and 65.

In accordance with the present invention and as an important deparature from the prior art as represented in the U.S. Pat. No. 3,007,223, or other prior apparatus or method, the fabric tube 53 must be stretched or overextended in its width in excess of the amount of material of said fabric which is "lost" or used up during longitudinal compression when the fabric is brought into contact with belts 64, 65. The way in which such stretching is accomplished is by providing form 62 and the enlarged portion 72 thereof with sufficiently great widthwise dimensions to produce lateral or widthwise stretching, for example, of 25% or more of the fabric tube. It will be noted that the stretching of the tube will be initially greater due to passage over enlarged portion 72 and thereafter the tube will be permitted to relax to some extent while passing over form 62 between belts 64, 65 during longitudinal compression of the fabric.

Fabric 53 is fed into the device at a rate of speed such that the outside of the belts are traveling at points of contact with fabric 53 at 73 and 74. Due to the stretched condition of the outsides of the belts, this speed is substantially more than the speed of each belt at its straight-away portion. Because the coefficients of friction between belts 64 and 65 and fabric 53 is much greater than that between fabric 53 and form 62, fabric 53 is propelled with outer surfaces 68 of belts 64 and 65 so that the initial contacts 73 and 74 between fabric 53 and belts 64, 65 will remain the same throughout the operation. The rollers of the respective belts may be mounted adjustably to accommodate different thicknesses of fabric. Fabric 53 is pressed against form 62 by the proximate straight runs of belts 64 and 65 either by inherent action or by suitable means such as spring pressed rolls 75. By providing belts which are wider than form 62, the entire overextended width of the fabric will be treated and positive control over length and width shrinkage is afforded.

After leaving belts 64, 65 and form 62, fabric 53 may be passed between heated rollers 76 (which have the same peripheral speed as the linear speed of the straight-run portions of belts 64, 65 by means of drive source 55 and speed control 77) and passed through belted dryer 78 of known design. Belted dryer 78 is used to dry all-cellulosic knitted fabrics. For fabrics blended of man-made thermoplastic fibers with cellulosic fibers, belted dryer 78 is also used to heat such fabrics to the ductility ranges of the man-made thermoplastic fibers to that on subsequent cooling, the man-made thermoplastic fibers become heat set.

If the knitted fabric has an open web rather than being tubular, a rubber-belt compressive-shrinkage unit such as described in U.S. Pat. Nos. 2,021,975 and 2,146,694 and as generally designated 81 in FIG. 2 would be employed. The fabric is first dampened in a relaxed condition by water-spray and steam boxes 63 with relaxation developed by running outlet rollers 82 at a slower speed than feed rollers 54 by means of drive source 55 and speed controllers 56 and 83. Open-web fabric **53*a* enters compressive-shrinkage unit 81 which includes heated drum 84, a pair of relatively small diameter belt pressure and tension rollers 85, idler roller 86 and relatively thick rubber belt 87 that passes beneath rotatable drum 84 and around rolls 85 and 86. Open-web fabric 53*a* enters the leading nip between belt 87 and drum 84 and becomes compressed longitudinally or preshrunk by the action of belt 87 as the belt's contacted surface portion changes from an elongated condition under tension around lead roller 85 and to a contracted condition under compression around drum 84**.

As shown in FIGS. 2 and 2A, prior to its entering the compressive shrinking unit 81, the fabric 53*a* will first enter the width expander 100. The expander 100 includes a width presetting worm shaft 101 which has bearing mounts 102 at each end journalling for rotation pairs of counter-rotating, hard rubber rollers 103 and 104. Each roller has an outwardly spiralling projection thereon so that fabric passing through the nip of each roller pair will be held widthwise and will be stretched laterally prior to entering compressive unit 81. In accordance with an important teaching of the invention, the roller pairs 102 and 103 will be spaced apart widthwise to a desired dimension to stretch the fabric 53*a*. This is accomplished by rotating handle 104 attached to shaft 101. Fabric 53*a* should be stretched widthwise an amount sufficient to compensate for longitudinal compaction of the fabric during compressive shrinking, that is, an amount to prevent subsequent widthwise shrinking of the fabric substantially to the same extent as lengthwise shrinking is prevented. By way of contrast with the prior description relating to preshrinking of tubular fabric 53, the fabric 53*a* is released from widthwise stretching immediately prior to entering the preshrinking unit 81, but the fabric still enters the unit 81 in a stretched condition.

After the fabric is discharged from compressive-shrinkage unit 81, it is passed through belted dryer 78 which also serves in heat setting fabrics blended of man-made thermoplastic and cellulosic compounds. From belted dryer 78 the fabric is passed through plaiter 79 which deposits it in successive folds into receiving cart 88 for shipping, delivering or other processing steps and/or converting operations. In the case of fabrics of all-cellulosic fibers, it is necessary to have the fabrics remain at ambient temperature and humidity for at least 24 hours before they are processed further or converted.

For fabrics blended of man-made thermoplastic fibers with cellulosic fibers, the temperature of heated drum 89 of belted dryer 78 is maintained at not less than 300° F. and not more than 400° F. which satisfactorily dries and heats the man-made thermoplastic fibers to their range of ductility, but is not sufficient to degrade the cellulosic fibers. All temperatures of treating steps which precede belted dryer 78 are kept below 250° F., including (and not limited to) the pretreating of the greige goods. If desired, (as shown in FIG. 2) fabric 53 may be passed also about heated can 91 before entry into belted dryer 78. To complete the heat setting operation, rollers, such as 91, may be chilled by means well known in the art. For all-cellulosic fabrics, the temperature of heated drum 89 of belted dryer 78 is maintained at a temperature of not less than 300° F. and not more than 320° F. which satisfactorily dries the knitted all-cellulosic fabrics, but is not sufficient to degrade or scorch them. For this purpose, the all-cellulosic fabrics must not be dried below 3% regain. With all-cellulosic fabrics, a further rest and relaxation period of 24 hours is required for the fabric to reconstitute its regain from 3% to 6½%.

It will be apparent to those skilled in processing fabrics that wide deviations may be made from the foregoing specific embodiments without departing from the main theme of the invention bracketed by the claims which follow.

I claim:

1. A process for making tubular knit garment products having desired stitch and resiliency characteristics, comprising:

a. knitting a first greige fabric with known predetermined knit variables including stitch density and stitch length;

b. pre-treating the first greige fabric and converting the same into an elongated first tubular garment;

c. testing the stretch and resiliency characteristics of the first tubular garment by radially outwardly distending beyond its relaxed condition a predetermined substantial length of the first garment and determining the distending force per unit of length of garment distended required to distend the garment to a predetermined extent corresponding generally to the expected distinsion of the said first garment when worn in use;

d. repeating steps a), b) and c) with a series of n greige fabrics and n tubular garments made therefrom, the series of greige fabrics being knitted with the same knit variables and pre-treated in the same manner as the said first greige fabric except that stitch density and stitch length are altered in each fabric in the series;

e. observing and recording the relationship between said distending force per unit length of garment distended and stitch density and stitch length of greige fabric for each garment tested;

f. selecting from the relationships observed and recorded from step e) a stitch density and stitch length yielding a garment having a resistance to distension force in its worn condition of between 8 and 40 grams per inch;

g. knitting a final tubular knitted greige fabric in the same manner and having the same predetermined knit variables as said first greige fabric except for stitch density and stitch length, and with a stitch density and stitch length determined by step f) to yield a garment having a resistance to distension force in its worn condition of between 8 and 40 grams per inch;

h. pre-treating the final greige fabric in the same manner as the first greige fabric and converting same into tubular knit garment products, said products having desired stretch and resiliency characteristics derived from the above-recited process.

2. The process recited in claim 1, wherein the pretreating of the greige fabrics includes a pre-shrinking operation.

3. The process recited in claim 1 wherein the tubular knit garment products are men's undershirts, and wherein the selection of stitch density and stitch length in step f) is made to yield a tubular garment product having a resistance to distension force per unit length of between 10 and 30 grams per inch in its worn condition, and the final tubular knit greige fabric is knitted with that stitch length and density in accordance with step g), the final tubular knit garment products being made from the final greige fabric.

4. In a process for making a tubular, knit garment having a desired comfort fit, and which process comprises: knitting a fabric, said knit fabric being knit with a predetermined stitch length and stitch density; converting said knit fabric to a tubular garment; testing said tubular garment; repeatedly reknitting said fabric with adjusted stitch lengths and stitch densities; converting said reknit fabrics into other similar tubular garments; and converting a final reknit fabric into a final similar tubular garment; the improved procedure for testing and reknitting said tubular garments to determine stitch density and stitch length required to provide a comfort fit for the wearer of the final tubular garment, comprising the steps of:

a. testing the stretch and resilience of said tubular garments along a substantial length of the garments by determining the forces per lineal dimension of garment required to outwardly distend said knit and reknit fabrics to their condition of stress as said knit and reknit fabrics are used in similar tubular garments;

b. obtaining the relationship between the tested stretch and resilience of the tubular garments with a predetermined range of stretch and resilience required for a comfort fit for the wearer of a similar tubular garment of between 8 and 40 grams per inch of length when the similar tubular garment is stretched to actual wear conditions, said predetermined range of stretch and resilience being the range of force per lineal dimension of garment required to distend the similar tubular garment consistent with the comfort of the wearer of said tubular garment; and c. adjusting stitch length and stitch density in accordance with the relationships between stitch length and stitch density and comfort fit as determined in step (b), and reknitting the final reknit fabric with the adjusted stitch length and stitch density, the final reknit fabric having a stretch and resilience within said predetermined range of stretch and resilience required for a comfort fit for the wearer of a similar tubular garment made from the final reknit fabric of between 8 and 40 grams per inch when the last-said tubular garment is stretched to actual wear conditions.

5. The process of claim 4 wherein all of the said tubular garments are preshrunk after knitting and reknitting.

6. The process of claim 4 wherein the tubular garments are mens' undershirt and said range of stretch and resilience required for a comfort fit for the wearer is a force per lineal dimension of 10 to 30 grams per inch.

* * * * *